United States Patent [19]

Hourihan

[11] 4,399,994

[45] Aug. 23, 1983

[54] GOLF AID

[76] Inventor: James Hourihan, Cabra Rd., Thurles, Co. Tipperary, Ireland

[21] Appl. No.: 304,529

[22] Filed: Sep. 22, 1981

[30] Foreign Application Priority Data

Oct. 15, 1980 [IE] Ireland ..... 2134/80
Jul. 20, 1981 [IE] Ireland ..... 1633/81

[51] Int. Cl.[3] ..... A63B 69/36
[52] U.S. Cl. ..... 273/191 R; 273/194 R
[58] Field of Search ..... 273/191 R, 191 A, 191 B, 273/192, 190 R, 190 A, 190 B, 188 R, 194 R

[56] References Cited

U.S. PATENT DOCUMENTS 2,448,904 9/1948 Millner ..... 273/191 R
2,655,378 10/1953 Sheffer ..... 273/191 B
3,595,583 7/1971 Oppenheimer ..... 273/191 B

*Primary Examiner*—George J. Marlo

*Attorney, Agent, or Firm*—Sughrue, Mion, Zinn, Macpeak and Seas

[57] ABSTRACT

A device for constraining a golf club to swing through an arc of predetermined radius comprises an elongated club engaging member formed by a pair of telescoping members. A ring member encircles the golfer's neck and the outer telescoping member extends from the ring member. A bracket on the lower end of the inner telescoping member secures the device to the club shaft. When the player swings the golf club through a stroke the ring member defines the center of the arc of motion of the club, and the radius of the arc of motion is defined by the telescoping members and the ring member. The telescoping members may be spring-biased together, and handles may also extend from the side of the club engaging member so that a player by observing the tilt on the handles will know whether or not he has kept his arms straight during his stroke. A strap may also be worn around the player's neck to act as a guide for the ring member.

13 Claims, 12 Drawing Figures

GOLF AID

BACKGROUND TO THE INVENTION

Field of the Invention

The invention relates to a device for constraining a club, for example a hurley or hockey stick and in particular a golf club to swing through an arc of predetermined radius, and in certain cases to retain the centre of the arc fixed.

In golf, the arc through which a player moves the head of a golf club, for example, a putter, a wood, driver or iron, when striking the ball is critical. It is important that both the radius and the position of the centre of the arc are maintained constant during the swing. Indeed, it is maintaining these two parameters constant and in particular the radius of the arc, which provides most difficulty to golfers and much practice is required. Even with practice, golfers find difficulty in maintaining the radius of the arc constant. Many golfers unconsciously bend their elbows or shoulders when striking the ball.

Objects of the Invention

One object of the invention is to provide a device which golfers may use, in particular during practice, to constrain the golf club to swing through an arc or predetermined radius. It is also an object of the invention to provide a device which will retain the centre of the arc of motion of the golf club fixed in relation to the ball.

SUMMARY OF THE INVENTION

According to the invention there is provided a device for constraining a club of the type hereinbefore described to swing through an arc of predetermined radius, the device comprising a club engaging member defining the radius of the arc of motion of the club, one end of the club engaging member being adapted to engage the club, and the other end defining the centre of the arc of motion of the club.

In one embodiment of the invention the end of the club engaging member defining the centre of the arc of motion of the club terminates in a neck engaging member adapted to engage the players neck.

Preferably, the neck engaging member is a ring member.

Alternatively, the end of the club engaging member which defines the centre of the arc of motion of the club terminates in the hook engaging member adapted to engage a hook the position of which is fixed relative to the ground.

In another embodiment of the invention the club engaging member is an elongated member.

Advantageously, the club engaging member is formed by two elongated telescoping members, one telescoping into the other.

Preferably, the telescoping members are biased to telescope together.

In a still further embodiment of the invention locking means are provided to lock the two telescoping members relative to each other.

In another embodiment of the invention the club engaging member is pivotally connected to the neck or hook engaging members.

In a still further embodiment of the invention a strap member adapted to engage the neck having guide means to retain the neck engaging member on the strap is provided. Preferably, the guide means is provided by a plurality of pairs of pins defining a path for the neck engaging member.

ADVANTAGES OF THE INVENTION

The advantages of the invention are many, the main advantage being that the device constrains a club, and in turn the club head to move through an arc of constant predetermined radius. When the club engaging member terminates, in the neck engaging ring member, the centre of the arc of motion of the club is defined by the players neck. Provided the player retains his neck in a fixed position relative to the ball, the centre of the arc of motion of the club head remains fixed. When the neck engaging member is provided by a ring member, the advantage of this is that the neck engaging member can readily easily be fitted and removed to and from the players neck.

A particular advantage of the invention is achieved when the club engaging member terminates in a hook engaging member, which is in turn affixed to a hook fixed on, for example, a wall. In this case the centre of the arc of motion of the club is fixed irrespective of movement of the golfer.

A further advantage of the invention is achieved when the club engaging member is provided by telescoping members in this case the length of the club engaging member, and in turn the radius of the arc of motion through which the club is constrained to move may be adjusted to facilitate players of different height.

These and other objects and advantages of the invention will be readily apparent from the following description of some preferred embodiment thereof which are given by way of example only and do not limit the scope of the invention.

DETAILED DESCRIPTION OF THE INVENTION

Figure 3:
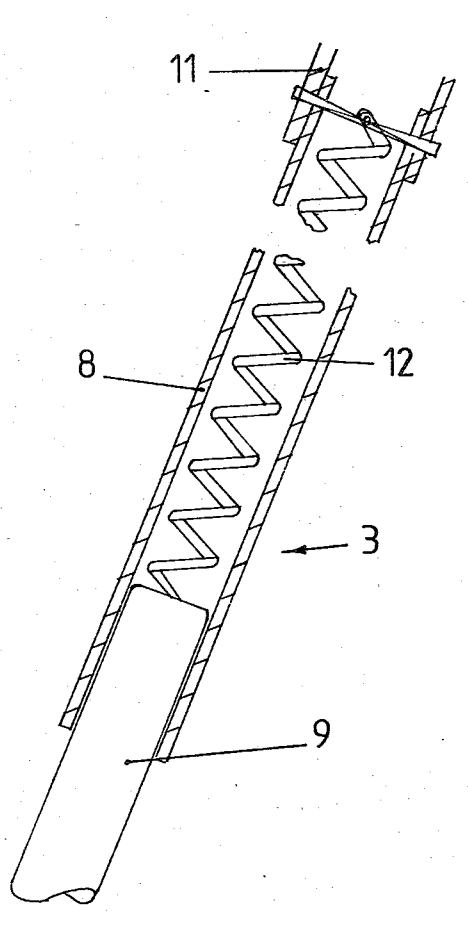
FIG. 3 is a sectional view of a portion of the device on the line III—III of FIG. 1.
Figure 2:
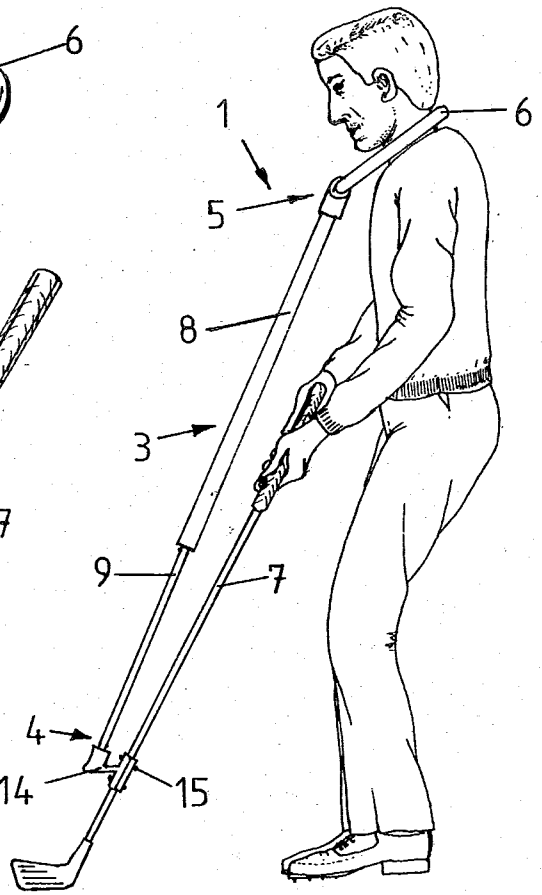
FIG. 2 is a perspective view of the device of FIG. 1 in use.
Figure 1:
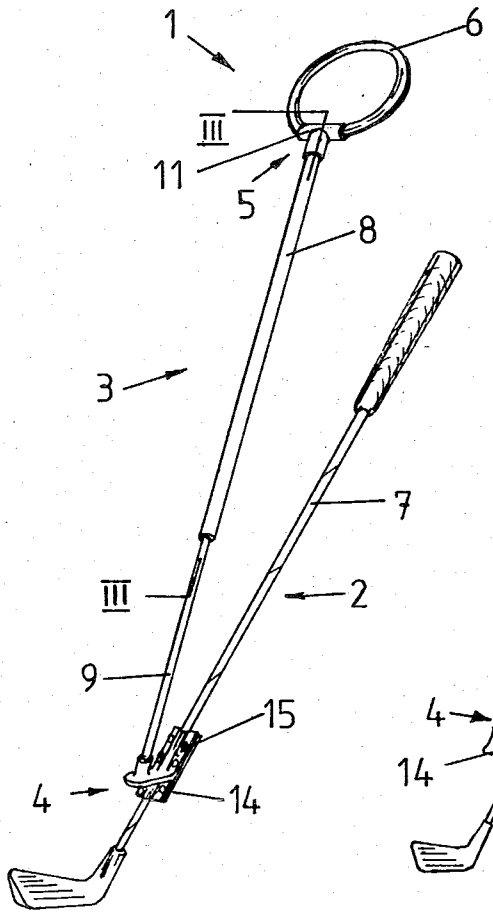
FIG. 1 is a perspective view of a device according to the invention illustrated attached to a golf club.

Referring to the drawings and initially to FIGS. 1 to 3 thereof, there is provided a device according to the invention indicated generally by the reference numeral 1 for constraining a golf club 2 to swing through an arc of predetermined radius. The device 1 comprises a club engaging member 3, one end 4 of which is adapted to engage a shaft 7 of the golf club 2. The other end 5 terminates in a neck engaging ring member 6 which defines the centre of the arc of motion of the club 2. The neck engaging ring member 6 is of tubular plastics material of circular cross-section. The diameter of the ring member 6 is such as to permit it to pass over the players head to engage his neck as illustrated in FIG. 2. The club engaging member 3 is provided by a pair of telescoping members 8 and 9 to permit adjustment of the length of the member 3. The outer telescoping member 8 is of tubular plastics material of circular cross-section and is attached to the ring member 6 by a T-piece 11 also of plastics material. The inner telescoping member 9 also of plastics material is attached to the outer member 8 by a tension spring 12 which biases the two members 8 and 9 together. The device 1 is secured to the golf club 2 by means of a two piece mounting bracket 14 one piece of which is mounted at the end of the inner telescoping member 9.

Screws 15 are provided to clamp the golf club shaft 7 between the two pieces of the bracket 14.

It can be seen that the device 1 according to this embodiment of the invention may be secured to any desired position along the shaft 7 of the golf club 2. However, in practice it has been found preferable to have the bracket 14 engage the shaft adjacent the club head. In this way the club engaging member 3 essentially defines the radius of the arc of motion of the golf club head.

In use, the device 1 is secured at the desired position along the shaft 7 of the golf club 2, for example a driver, putter or the like. The ring member 6 is passed over the players head to engage his neck. The golfer grips the handle 7 of the club 6 in conventional fashion, and applies downward pressure on the golf club 2 to extend the telescoping members 8 and 9 to the desired amount to address the ball. The player then maintains a constant pressure on the golf club, accordingly, retaining the members 8 and 9 in the desired fixed relative position and swings the golf club to strike the ball. It will be appreciated, that provided the player maintains a fixed pressure on the golf club at all times during the swing, the two telescoping members 8 and 9 will be retained in the same relative position, thereby, causing the club and in turn, the club head to move through an arc of fixed radius. Provided the player retains his neck in a fixed position relative to the ball during the swing of the stroke, the centre of the arc of motion of the club head will also be fixed. This will enable the golfer to achieve a substantially perfect stroke. Accordingly, the device is ideally suited for a golfer to practice his swing.

It has been found that one of the advantages of forming the club engaging member 3 from a pair of telescoping members 8 and 9 which are spring biased is that the spring biasing tends to retain the ring member 6 in engagement with the players neck.

Figure 11:
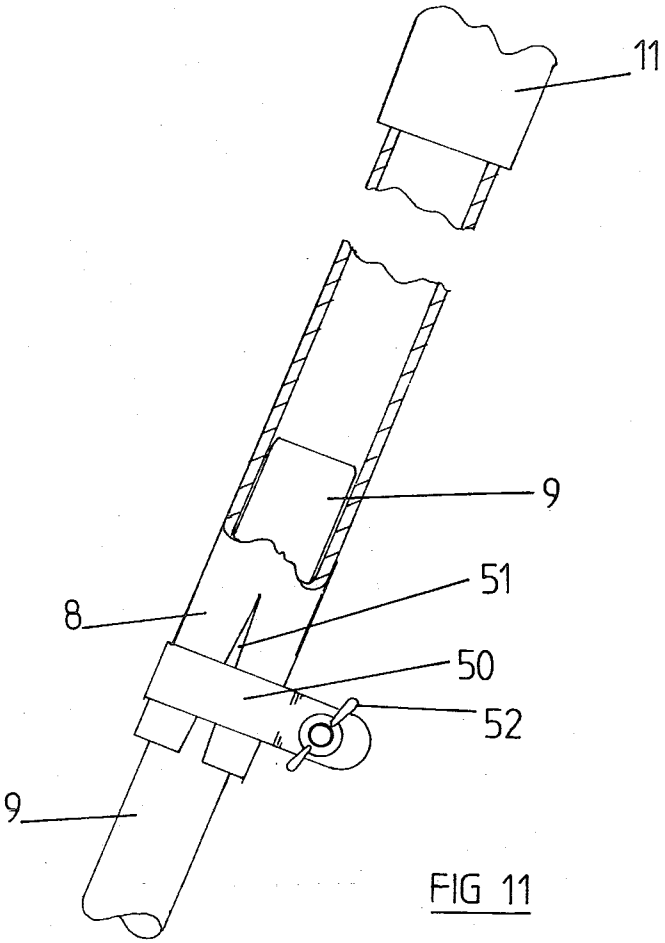
FIG. 11 is a view substantially similar to FIG. 3 of a portion of a device according to another embodiment of the invention.

Referring now to FIG. 11 a portion of a device according to another embodiment of the invention is illustrated. This device is substantially similar to that just described, and like reference numerals are used to identify similar components. The main difference between this device and the device just described is that the telescoping members 8 and 9 are not spring biased. In this case the member 9 is slideable in the member 8 to the desired position and a locking means provided by a jubilee clip 50 around the member 8 retains the members 8 and 9 in the desired position. A slot 51 in the member 8 permits the internal diameter of the member 8 to be reduced so that it clamps the member 9 on tightening of the jubilee clip 50. A wing nut 52 is provided to tighten the jubilee clip 50.

In use, the members 8 and 9 are adjusted to the desired amount to achieve the desired radius of arc of the club head. The jubilee clip is tightened on the member 8 thereby clamping and retaining the member 9 in the desired position. Needless to say, although a locking means provided by a jubilee clip has been described, other suitable locking means could be used, for example, it is envisaged that a grub screw could be provided in the member 8 to engage and retain the member 9 in the desired position. Alternatively, a plurality of transverse holes could be provided in the member 9, alignable with a corresponding pair of transverse holes in the member 8. A pin engagable with the holes in the members 8 and 9 would retain the members in the desired position.

Figure 4:
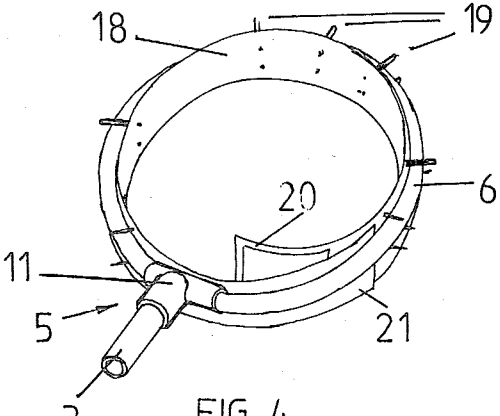
FIG. 4 is a perspective view of a portion of a device according to another embodiment of the invention.

FIG. 4 illustrates a portion of a device according to another embodiment of the invention. This device is substantially similar to the device 1 just described, and accordingly, similar components are identified by the same reference numeral. In this device 1, a strap member 18 of leather is provided for engaging the neck of the player. A guide means provided by pairs of pins 19 projecting from the strap member 18 define a path to retain the neck engaging member 6 of the device 1 in position on the neck of the player. Ends 20 and 21 of the strap member 18 are provided with a securing means, in this embodiment of the invention material sold under the Trade name "VELCRO" is provided on each end 20 to 21 of the strap member 18 so that the strap member 18 may be secured around the neck of the golfer. When the strap member 18 is worn around the neck of a player using the device 1 irratation to the neck which may occur from using the device 1 is avoided. It is envisaged that the strap member 18 may be particularly suitable for lady golfers.

Figure 5:
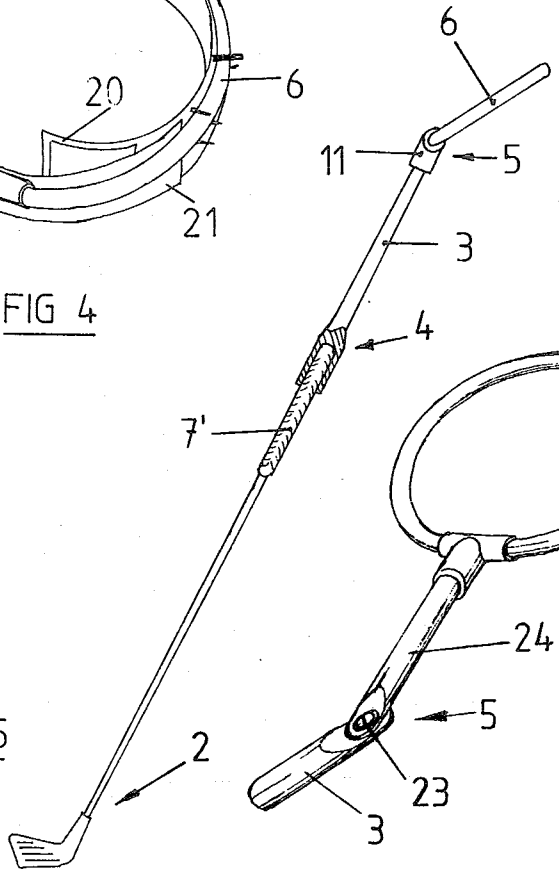
FIG. 5 is a perspective view of a device according to a further embodiment of the invention.

Referring now to FIG. 5 a device according to a further embodiment of the invention is illustrated. In certain respects this device is similar to those just described, and similar components are identified by the same reference numeral. In this embodiment of the invention the club engaging member is provided by a single elongated member 3 of tubular plastics material of circular cross-section. The end 4 of the member 3 is adapted to receive and engage the handle 7' of the golf club 2 within its bore. The diameter of the bore of the member 3 is such as to permit a press fit onto the end of a golf club. A T-piece 11 of plastics material secures the other end 5 of the club engaging member 3 to a neck engaging ring member 6 also of plastics material. The diameter of this ring member 6 is such as to permit the ring member to pass over the head of a player.

In use, the ring member 6 is engaged on the neck of the player. The player grips the handle 7' of the golf club 2 in a conventional manner, and swings the club. Again, as with the device illustrated with reference to FIGS. 1 to 3, the radius of the arc of motion of the golf club head is fixed by virtue of the device 1. Similarly, as described with reference to FIGS. 1 to 3, the centre of the arc of motion is also fixed provided the player keeps his neck in a fixed position relative to the ball for the duration of the stroke.

It has been found desireable in use, to apply some downward pressure on the golf club 2 in order to maintain the ring member 6 in engagement with the neck of the player.

If it is desired to alter the radius of the arc through which the club is moved, this can be achieved by varying the amount by which the club handle 7' engages the bore of the club engaging member 3.

Figure 6:
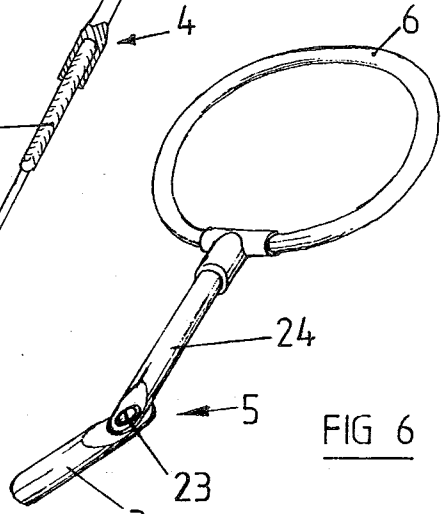
FIG. 6 is a perspective view of a device according to a still further embodiment of the invention.

FIG. 6 illustrates a device according to a further embodiment of the invention. This device is in many respects similar to those just described and similar components are identified by the same reference numeral. In this embodiment of the invention the club engaging member 3 is pivotally connected by means of a pivot 23 to an extension member 24 projecting from the neck engaging ring member 6. The pivot 23 permits the club engaging member 3 to swing relative to the ring member 6. This it will be appreciated transposes the centre of the arc of motion on the club to the pivot 23, and similarly, the radius of the arc of motion of the club head extends from the pivot 23. This embodiment of the invention has certain advantages when it is desired to swing the club through an arc of motion with centre displaced from the neck of the player. In this embodiment of the invention the club engaging member 3 engages the club handle 7' by means of its bore as in the case of the device illustrated in FIG. 5.

Figure 7:
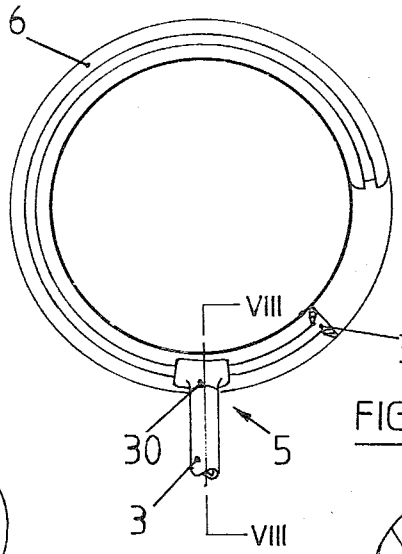
FIG. 7 is a front elevational view of a portion of a device according to another embodiment of the invention.
Figure 8:
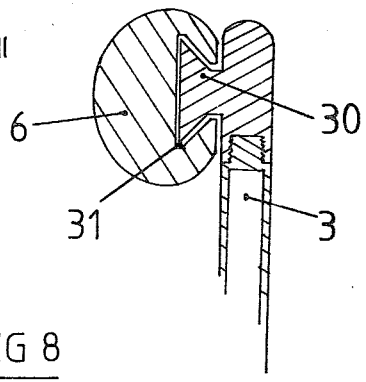
FIG. 8 is a sectional view of portion of the device on the line VIII—VIII of FIG. 7.

A still further embodiment of the invention is illustrated with reference to FIGS. 7 and 8. Again, similar components are identified by the same reference numeral. In this embodiment of the invention the club engaging member 3 slideably engages the ring member 6. The club engaging member 3 is provided with a head portion 30 of dove-tail shape, which engages a complementary track 31 extending around the ring member 6. The advantage of this device 1 is that as the golf club is swung through a stroke, the club engaging member slides around the ring member 6, thereby permitting the ring member 6 to remain stationary on the players neck. Accordingly, any possible irratation to the players neck is avoided. It will be appreciated of course that the club engaging member could slideably engage the ring member 6 by other suitable means. For example, it is envisaged that a small ring on the end of the club engaging member could slideably engage the ring member 6.

Figure 9:
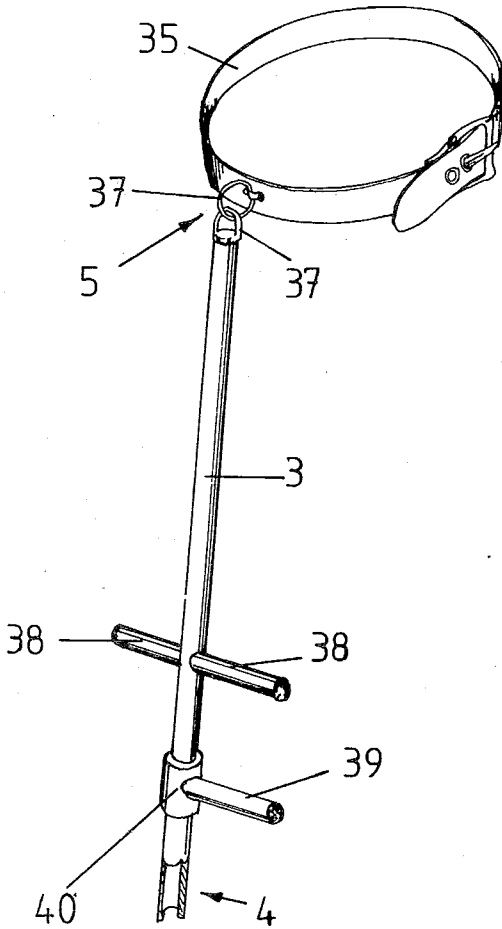
FIG. 9 is a perspective view of a device according to another embodiment of the invention.

FIG. 9 illustrates a device according to a still further embodiment of the invention. Again similar components are identified by the same reference numeral. In this embodiment of the invention the neck engaging member is provided by a strap 35 of leather, or indeed if desired, of plastics material. A buckle 36 on the strap 35 secures the strap around the golfers neck. The club engaging member 3 is again provided by a single member of the tubular plastics material of circular cross-section. A pair of interengaging rings 37 secured respectively to the club engaging member 3 and the strap 35 pivotally connect the member 3 to the strap 35. Accordingly, the strap 35 may remain in a fixed position on the players neck, thereby avoiding discomfort to the player. It will be appreciated that in this embodiment of the invention the centre of the arc of motion of the club head is at the point of interengagement of the rings 37. Similarly, the radius of the arc of motion of the club head extends from the point of interengagement of the interengaging rings 37.

In this embodiment of the invention the club engaging member 3 engages the club handle 7' by means of its bore as in the case of the device illustrated in FIG. 5.

Handles 38 project from opposing sides of the club engaging member 3 for the player to grip. In use, the player can grip the handles 38. The advantage of the handles 38 is that the player by observing the tilt of the handles 38 can ascertain whether or not he has kept his shoulders straight during the stroke.

A further handle 39 is slideably attached to the club engaging members 3 by means of a sliding bracket 40. In use, the player can hold the handle 39 with his left or right hand depending on whether he is a left or right hand golfer while holding the golf club with the other hand. By observing whether or not the handle 39 slides on the club engaging member 3 he can ascertain if he bent his elbow during the stroke. Needless to say, if the handle 39 slides up the club engaging member 3 the golfer will have bent his elbow.

It is envisaged that further sidewardly projecting members may be mounted on the club engaging member. Said sidewardly projecting members being used as a sight to align his stroke with the hole. It is envisaged that such sidewardly projecting members would be particularly useful for putting.

Figure 10:
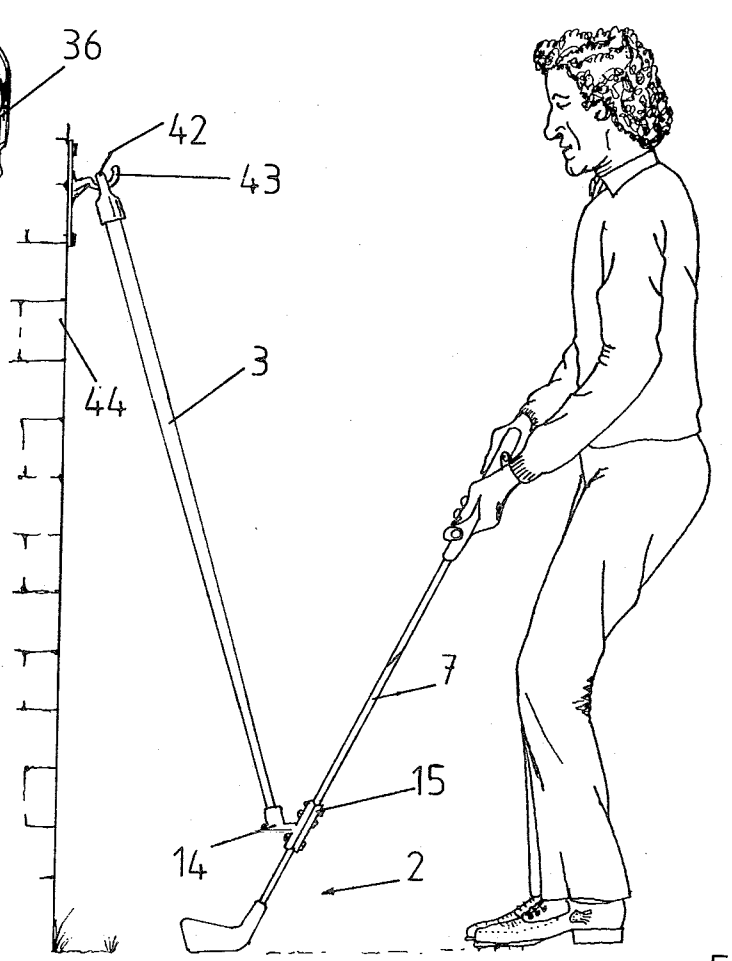
FIG. 10 is a perspective view of a device according to a still further embodiment of the invention in use.

Referring now to FIG. 10 there is provided a device according to a still further embodiment of the invention, components similar to those described with reference to the earlier embodiments are identified by the same reference numerals. In this embodiment of the invention the device ensures that the centre of the arc of motion of the club head is fixed during the stroke, while at the same time maintaining the radius of the arc constant during the stroke.

The device comprises a club engaging member 3, provided by a single tubular member of plastics material. Although, needless to say, if desired, the club engaging member could be provided by a pair of telescoping members. A mounting bracket 14 at the end 4 of the club engaging member 3 is provided to secure the club engaging member 3 to the golf club shaft 7 adjacent the head of the golf club. The other end 5 of the club engaging member 3 terminates in a hook engaging ring member 42 which defines the centre of the arc of motion of the club. The ring member 42 engages a hook 43 secured in a wall 44. The hook 43 should preferably be substantially at the level of the players neck. It is envisaged that the hook member 43 could be slideably mounted on a wall so that the hook could be vertically adjusted for varying heights of players.

In use, the ring member 42 is engaged on the hook 43 and the player uses the golf club 2 in conventional fashion. The advantage of the device according to this embodiment of the invention is that the centre of the arc of motion of the club head is fixed. It has been found that by constant practice using this device, the golfer is disciplined into keeping his neck in a fixed position relative to the ball, and accordingly, essentially becomes accustomed to keeping his neck in the correct relative position.

Figure 12:
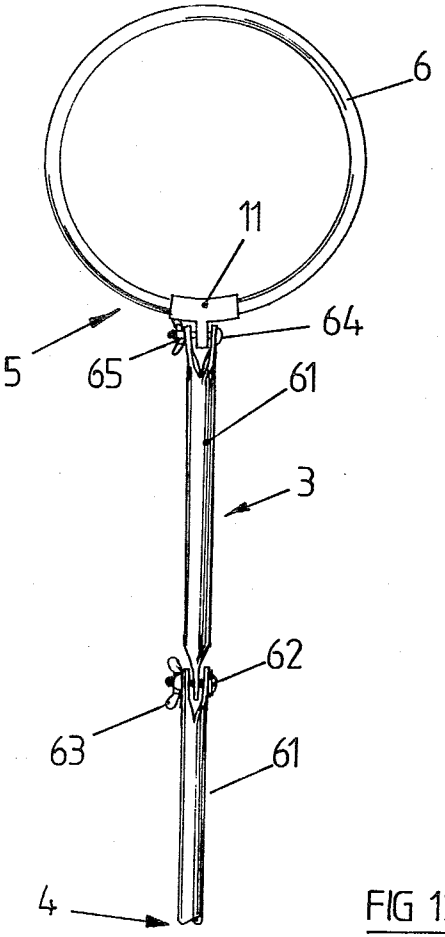
FIG. 12 is a front elevational view of a device according to a still further embodiment of the invention.

Referring now to FIG. 12 there is provided a device according to a still further embodiment of the invention. This device is substantially similar to those just described, and again, like reference numerals are used to identify similar components. In this embodiment of the invention the club engaging member 3 is hinged intermediate its ends at 60 by a pivot pin 62 joining the portions 61. This permits the member 3 to be folded for ease of carrying and storing. A wing nut 63 on the pivot pin 62 permits the two members 61 to be locked together to form a rigid club engaging member 3. The upper member 61 is also hingedly connected to the neck engaging ring member 6 by means of a pivot pin 64 so that the ring member 6 may be folded over the members 61 for storage. A wing nut 65 is provided to lock the member 61 to the ring member 6 in the desired position.

The advantage of the device according to this embodiment of the invention is that the members 61 of the club engaging member 3 may be folded to lie parallel to each other and the ring member 6 may also be folded to lie substantially parallel to the member 61. This provides a device which may be easily packed away for storage and carrying.

Instead of using wing nuts to lock the members 61 rigidly together, other suitable means could be provided. For example, it is envisaged that a sleeve slideable on the members 61 could be provided to embrace the portion 60 of the two members 61, thereby retaining them rigidly together.

It will be appreciated that while the device according to the various embodiments of the invention have been described as being of particular construction, other suitable constructions could have been used. For example, it is envisaged that the neck engaging member could be provided by members other than rings, for example, if desired a flexible member could be used, for example, a cord. Furthermore, it is envisaged, that the ring member could be of smaller diameter than the players head. In which case, the ring member could be in two portions pivotally connected together and having a snap catch to lock the member around the golfers neck.

Indeed, it is also envisaged that the neck engaging member could be formed by a hook member for example, similar to the hooked end of a shephards staff or crozier or the like. Furthermore, although the device has been described as being manufactured from plastics material, other suitable materials could have been used, for example, in certain cases it is envisaged that steel or light aluminium alloy could be used.

Although, the devices of the invention have been described as being mounted on a golf club handle or shaft adjacent one end or the other, it will be appreciated that in particular, the device described with reference to FIGS. 1 to 3 could be mounted in any desired position intermediate the ends of the golf club. Indeed, it is envisaged that the devices described with reference to FIGS. 5 to 10 could if desired be provided with a club engaging member formed from a pair of telescoping members. Additionally, it will be appreciated that in certain cases it may be desireable that the club engaging member could be formed from three or more telescoping members. Indeed in certain cases it is envisaged that the club engaging member could be provided by a flexible member, for example, a cord or chain. Furthermore, it will be appreciated that other suitable types of mounting brackets other than that described with reference to FIGS. 1 to 3 could be used.

It is envisaged that in certain cases where the club engaging member is provided by telescoping members, the members instead of being of circular cross-section could be of square or oval cross section. This would prevent any possible relative rotation between the two members. Indeed, in certain cases if desired the telescoping members could be keyed together. It is thought, that in certain cases it may be advantageous to prevent relative rotation between telescoping members in order to maintain the angle of the club face constant. It is believed that this would be particularly advantageous for the beginner golfers.

It is also envisaged that while the device according to the invention has been described for use with a golf club it could be used in conjunction with any other types of club, for example, hurley or hockey sticks.

It will also be appreciated by those skilled in the art that in the case of the device illustrated with reference to FIG. 4 the guide means could have been provided by other suitable means, for example, hooks and eyes or the like, which would engage the neck engaging ring member. Indeed it will be appreciated that securing means, other than "VELCRO" could have been used. For example, a conventional buckle.

I claim:

1. A device for constraining an elongated game club to swing through an arc of predetermined radius, the device comprising: a neck engaging member defining the center of the arc of motion of an elongated game club and adapted to engage a player's neck, and an elongated club engaging member one end of which terminates in the neck engaging member and the other end being adapted to engage the club, the club engaging member in combination with the neck engaging member defining the radius of the arc of motion of the club.

2. A device as claimed in claim 1 in which the club engaging member is formed by two elongated telescoping members one telescoping into the other.

3. A device as claimed in claim 2 in which the telescoping members are biased to telescope together.

4. A device as claimed in claim 3 in which locking means are provided to lock the two telescoping members relative to each other.

5. A device as claimed in claim 1 in which the club engaging member is pivotally connected to the neck engaging member.

6. A device as claimed in claim 1 in which the club engaging member is hinged intermediate its ends.

7. A device as claimed in claim 1 in which the club engaging member is adapted to engage the club intermediate the ends thereof.

8. A device as claimed in claim 1 in which the club engaging member is adapted to engage a club shaft adjacent the head of the club.

9. A device as claimed in claim 1 in which a strap member to engage the neck having guide means to retain the neck engaging member on the strap is provided.

10. A device as claimed in claim 1 in which the device is adapted to engage a golf club.

11. A device as claimed in claim 1 in which a handle provided by a transverse member projects sidewardly from the club engaging member.

12. A device as claimed in claim 11 in which the handle is slideable on the club engaging member.

13. A device as claimed in claim 1 in which the neck engaging member is a ring member.

* * * * *